United States Patent [19]

Durenec

[11] 4,414,824

[45] Nov. 15, 1983

[54] CRYOGENIC COOLER ADAPTER PLATE

[75] Inventor: Peter Durenec, Annandale, Va.

[73] Assignee: The United States of America as represented by the Secretary of the Army, Washington, D.C.

[21] Appl. No.: 429,655

[22] Filed: Sep. 30, 1982

[51] Int. Cl.[3] ..... F25D 19/00

[52] U.S. Cl. ..... 62/295; 62/6; 62/514 R; 248/637; 417/363

[58] Field of Search ..... 62/45, 295, 297, 514 R, 62/6; 248/637, 645; 417/363

[56] References Cited

U.S. PATENT DOCUMENTS

| | | | |
|---|---|---|---|
| 2,685,178 | 8/1954 | Eck | 62/295 |
| 3,627,029 | 12/1971 | Osborne et al. | 62/514 R |
| 3,721,106 | 3/1973 | Bierwirth et al. | 62/297 |
| 3,746,290 | 7/1973 | Sholtes | 62/297 |

*Primary Examiner*—Ronald C. Capossela

*Attorney, Agent, or Firm*—Robert P. Gibson; Milton W. Lee; Aubrey J. Dunn

[57] ABSTRACT

In order to use a common module cryogenic cooler with two different types of thermal nights, an adapter plate is required for mounting the cooler to the sights. The plate has its two opposite sides differently machined to fit against the walls of corresponding sights, and has a central opening for a cooler mounting flange. For one sight, one side of the adapter is screwed to the sight wall and the cooler flange is inserted in the central opening. For the other sight, the other side of the adapter is inserted into a recess in the sight wall, and is retained by a retainer plate screwed to the wall. The cooler flange is inserted into the adapter plate central opening through a hole in the retainer plate.

3 Claims, 6 Drawing Figures

CRYOGENIC COOLER ADAPTER PLATE

The invention described herein may be manufactured, used, and licensed by the U.S. Government for governmental purposes without the payment of any royalties thereon.

BACKGROUND OF THE INVENTION

This invention is in the field of mounting devices for mechanical cryogenic coolers. These coolers each include a compressor portion (Stirling cycle or the like) driven by an electric motor, and an expansion or cold finger portion. As currently made, the compressor is mounted on one side of a mounting flange, with the cold finger extending out the opposite side of the flange. The coolers thus made are used for cooling infrared detectors of various night-vision devices, and are each mounted to such devices by sealing the mounting flange in an opening in the device. The sealing may be accomplished in various ways, such as by using o-rings between the flange and the device, or by using adhesives, etc. The instant invention arose because there was a need for an adapter that would allow a given cooler to be used with more than one night-vision device. In particular, the U.S. Army is currently using a cooler known as the "common module" cooler which is employed in various pieces of night-vision equipment. Unfortunately, some equipments have been designed which cannot use the common module without various different adapter plates. Having these different plates makes for supply and logistics difficulties. It is desirable to minimize the number of various different adapters needed, and this the invention does. Two specific examples of equipment with such different adapter plates are the tank thermal night (TTS) and the tank infrared sight (TIS) as used in the new MI tank. The instant invention is for a single adapter plate made with both TTS and TIS.

SUMMARY OF THE INVENTION

The invention is an adapter plate for mounting a common module cooler to either a TTS or a TIS. The adapter has on one side the proper alignment pins and screws holes for mounting on the surface of a TTS housing and different such pins and holes on th other side for mounting on a TIS housing. The common module has a mounting flange with a cold finger on one side and a cryogenic compressor on the other side. The flange is inserted into an opening in the adapter and the cold finger extends into the equipment housing. When used with TIS equipment, a retainer plate is used to hold the adapter plate to the TIS housing.

DESCRIPTION OF PREFERRED EMBODIMENT

Figure 1:
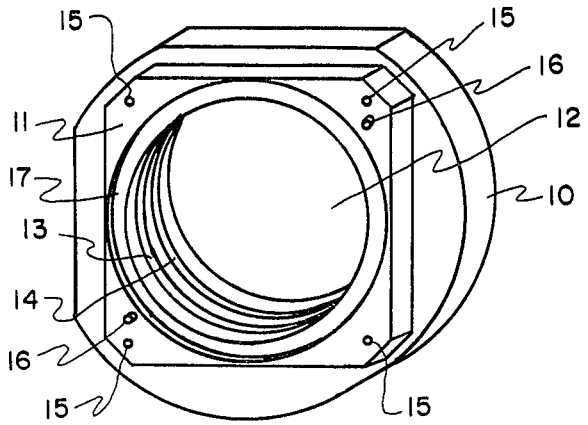
FIG. 1 is a pictorial view of one side of the inventive adapter plate.

The invention may be best understood when this description is taken in conjunction with the drawings. FIG. 1 shows one side of the inventive adapter plate wherein reference numeral 10 designates the discoid adapter with irregular octagon (generally square) embossment 11. The adapter is pierced by center bore 12; inside this bore are o-ring grooves 13 and 14. In embossment 11 are bored and tapped holes 15; pins 16 extend outward from 11. Finally, shallow undercut 17 is formed in the face of embossment 11.

Figure 2:
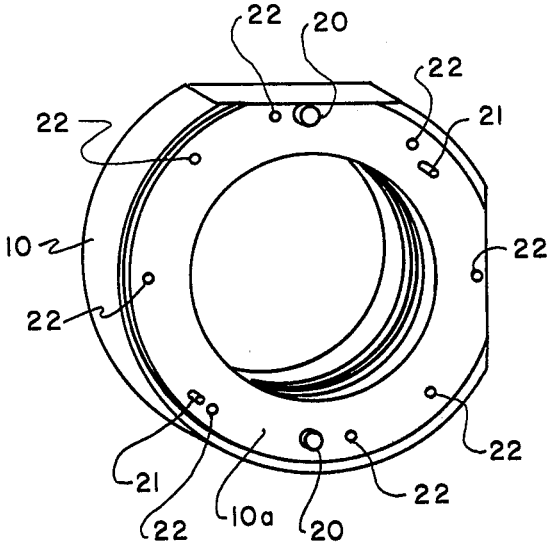
FIG. 2 is a pictorial view of the other side of the invention adapter plate.

Referring now to FIG. 2, the other side of adapter 10 may be seen. On face 10*a* we see large aligning pins 20 and small aligning pins 21. Bored and tapped in 10*a* are holes 22.

Figure 3:
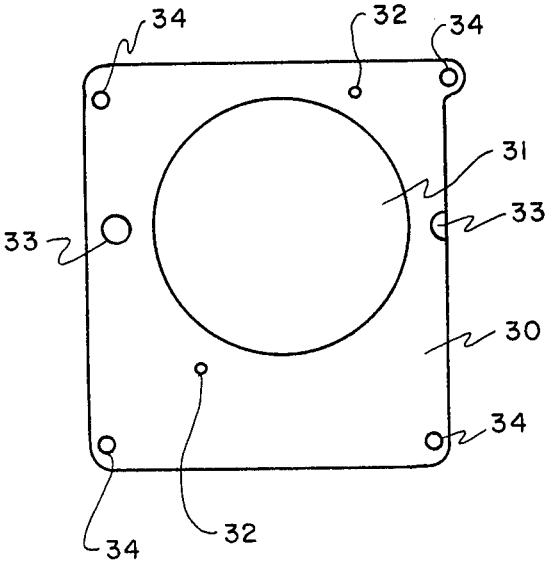
FIG. 3 is a plan view of a retainer plate for one use of the adapter plate.

FIG. 3 shows retaining plate 30 having central opening 31, small pin clearance blind holes 32, large pin clearance blind holes 33, and screw clearance holes 34.

Figure 4:
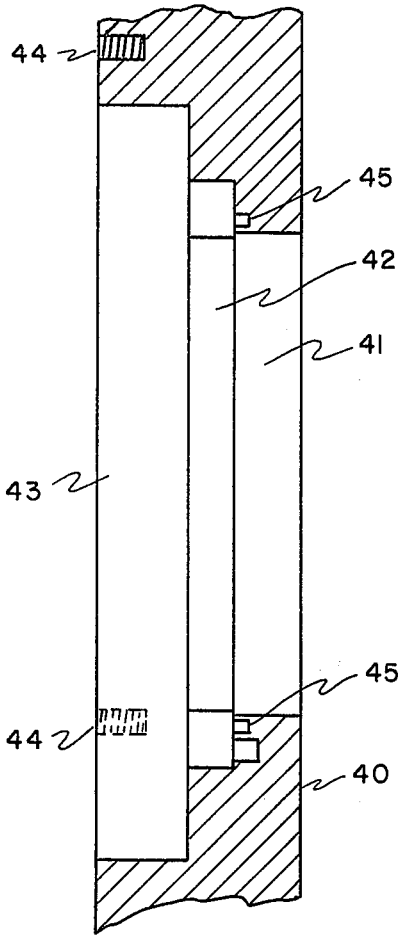
FIG. 4 and 5 are partial sectional views the walls of the two thermal sights with which the invention is used. Those views are drawn to twice the scale of FIG. 1–3.

FIG. 4 shows a sectional view of a wall portion 40 for a TIS. This view is taken through the center of circular opening 41 in 40 and is twice the scale of FIG. 1–3 to show its details better. Concentric with 41 is an irregular octagon (generally square) hole 42 to which embossment 11 of FIG. 1 corresponds. Also concentric to 41 is round hole, to which the diameter of adapter plate 10 corresponds. Wall 40 is bored with various holes, such as tapped screw holes 44 and guide holes 45.

Figure 5:
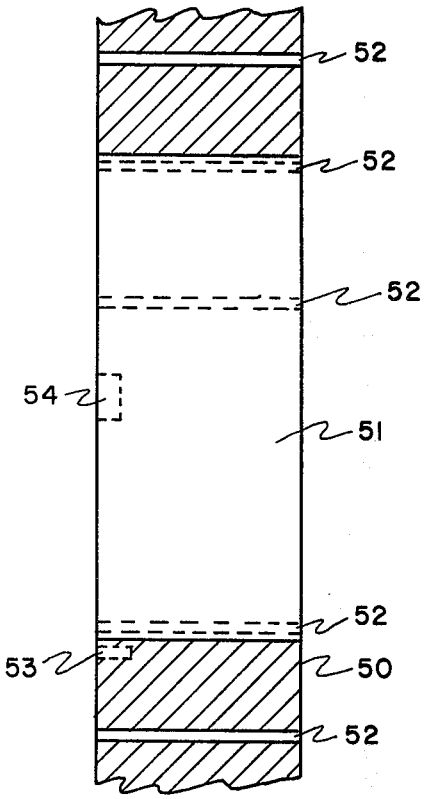

FIG. 5 shows a sectional view of a wall portion 50 for a TTS. This view is taken through the center of circular opening 51. Screw clearance holes 52 are bored through 50; tapped holes 22 of FIG. 2 correspond to holes 52. Wall 50 is also bored for small alignment pin holes, only one being shown as reference numberal 52, and large alignment pin holes, only one be shown as 54.

Figure 6:
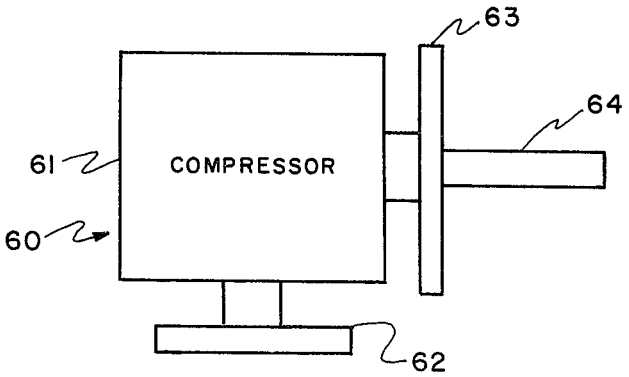
FIG. 6 is a side view of a cryogenic cooler with which the invention is used

Finally, FIG. 6 shows a cooler 60 with which the adapter is used. This cooler includes compressor 61 with base 62, mounting flange 63, and cold finger 64.

USE OF THE ADAPTER

The adapter of FIGS. 1 and 2 may be used to mount cooler 60 to either the TIS housing wall 40 of FIG. 4 or the TTS housing wall 50 of FIG. 5. For mounting 60 to 40, one proceeds as follows: o-rings (not shown) are installed in grooves 13 and 14, and a seal (not shown) is installed in undercut 16; 10 is then installed in 40 such that embossment 11 fits into hole 42 and the remainder of 10 fits into hole 43. Alignment pins 16 extend into holes 45. Adapter 10 is held in place by retaining plate 30. This plate is placed onto 10 and 40 such that large alignment pins 20 of adapter 10 extend into clearance holes 33 and small alignment pins 21 of 10 extend into clearance holes 32. Screws (not shown) are inserted thorough screw clearance holes 34 into tapped screw holes 44. Flange 63 of compressor 60 is inserted through hole 31 of plate 30 into hole 12 of plate 10 forms a seal with the o-ring in groove 14 and the seal in undercut 16 presses against 40 and provides an air-tight seal. Although not shown, base 62 of cooler 60 is supported by and secured to a bracket or equivalent fixed to or forming a part of the TIS.

For mounting cooler 60 to wall 50 of the TTS, one inserts o-rings into grooves 13 and 14 of adapter 10. Adapter 10 is mounted to wall 50 such that small alignment pins 21 extend into small alignment holes such as 53, and large alignment pins extend into large alignment holes such as 54. The adapter is held to wall 50 by screws (not shown) extending through holes 50 into tapped holes 22. Flange 63 of compressor 60 is inserted into hole 12 of plate 10 and forms a seal with the o-ring in groove 13. As described above for TIS mounting, cooler 60 is supported by means not shown.

I claim:

1. An adapter plate for mounting a cryogenic cooler having a mounting flange to either of two different thermal sights, wherein one sight has a mounting wall with a first round hole extending part way through said wall, a generally rectangular hole concentric with but larger than said round hole and extending an additional part through said wall, and a second round hole concentric with the other holes but larger than them and extending the remaining part through said wall, and with screw holes in said wall and alignment pin holes at the bottom of said generally rectangular hole; wherein the other sight has a mounting wall with a large round hole therethrough, with small screw clearance holes therethrough, and with large and small alignment pin blind holes in one surface thereof, wherein said adapter plate includes:

a generally discoid plate having first and second opposite faces and a central round hole through said plate, wherein said first has a generally rectangular embossment thereon concentric with said central round hole, said embossment has a plurality of screw holes in its surface and at least one alignment pin extending from said surface, and said central round opening has parallel seal grooves in its perifiry and wherein said second face has at least one large alignment pin and least one small alignment pin extending therefrom and a plurality of screw holes therein, and means for retaining said plate in either sight, wherein said central round opening corresponds in size to said cooler mounting flange.

2. The adapter plate as set forth in claim 1 wherein said menas for retaining is a generally rectangular retainer plate with an opening therethrough corresponding to the size of said cooler mounting flange.

3. The adapter plate as set forth in claim 2 wherein said retainer plate has clearance holes is on surface thereof for said small and large alignment pins of said second face of said retainer plate, and has screw clearance holes therethrough corresponding to said screw holes in said wall of said one right.

* * * * *